United States Patent [19]

Saus et al.

[11] 4,298,405

[45] Nov. 3, 1981

[54] PROCESS FOR PRODUCING IRON PHOSPHATE COATINGS AT AMBIENT TEMPERATURE

[75] Inventors: J. Arthur Saus, Greenville; Larry P. McCartney, Grier, both of S.C.

[73] Assignee: Intex Products, Inc., Greenville, S.C.

[21] Appl. No.: 133,117

[22] Filed: Mar. 24, 1980

[51] Int. Cl.[3] ..... C23F 7/10

[52] U.S. Cl. ..... 148/6.15 R; 148/6.17

[58] Field of Search ..... 148/6.15 R, 6.17

[56] References Cited

U.S. PATENT DOCUMENTS

| | | | |
|---|---|---|---|
| 2,609,308 | 9/1952 | Gibson | 148/6.15 R |
| 3,127,288 | 3/1964 | Hines et al. | 148/6.15 R |
| 3,129,123 | 4/1964 | Rodzewich | 148/6.15 R |
| 4,140,551 | 2/1979 | Jones | 148/6.15 Z |

*Primary Examiner*—Ralph S. Kendall

*Attorney, Agent, or Firm*—Bell, Seltzer, Park & Gibson

[57] ABSTRACT

This invention relates to a process and composition for producing an iron phosphate conversion coating on a ferrous metal surface at ambient temperatures of from about 50° F. to about 100° F. The ferrous metal surface is contacted with an aqueous acidic phosphating solution having a pH within the range of 3 to 6 and consisting essentially of orthophosphate ions at a concentration of at least about 2.0 grams per liter and an ambient temperature activator comprising nitrite ions at a concentration of at least 0.08 grams per liter.

13 Claims, No Drawings

PROCESS FOR PRODUCING IRON PHOSPHATE COATINGS AT AMBIENT TEMPERATURE

FIELD OF THE INVENTION

This invention relates to a process of producing an iron phosphate coating at ambient temperatures on the surface of metals, particularly ferrous metals, and to compositions for producing such coatings.

BACKGROUND OF THE INVENTION

Iron phosphate conversion coatings are produced on a ferrous metal surface by contacting the metal surface with an acidic phosphate-containing solution which reacts with the ferrous metal surface. Iron present in the metal substrate undergoing treatment chemically reacts with the phosphating solution and redeposits on the surface to form a low weight, tightly adherent amorphous iron phosphate coating which provides highly effective corrosion resistance and serves as an excellent base for subsequent painting.

In order to form a coating of acceptable weight and quality within a reasonable period of time, it has been generally necessary for the phosphating process to be carried out at an elevated temperature of at least 120° F., and usually higher. Processing temperatures on the order of 140° F. to 160° F. are typical for conventional iron phosphating processes.

The economic and practical desirability of producing phosphate coatings at lower temperatures has been well recognized, and the iron phosphating field has been active with attempts to produce suitable low temperature phosphating compositions and processes. In the patent literature for example, broad references are made to low temperature or ambient temperature phosphating compositions and processes in a number of patents, such as the following: U.S. Pat. Nos. 3,152,018; 3,726,720; 4,017,335; and 4,149,909.

However, to applicants' knowledge, the iron phosphating compositions and processes which are presently available have been unsuccessful in producing iron phosphate coatings of acceptable quality and/or weight under truly ambient temperature processing conditions. Some products have been available commercially that would produce iron phosphate coatings in an ambient temperature phosphating bath, but only if the part to be processed has been suitably precleaned in a heated alkaline cleaning stage prior to the phosphating bath. Thus, this type of phosphating process still requires heating and thus cannot really be characterized as an ambient temperature process. As noted in U.S. Pat. No. 4,149,909, the necessity of obtaining effective cleaning of the metal surface has required the use of elevated temperatures, and has thus been an obstacle in the development of a truly ambient temperature phosphating system.

The rapidly escalating cost and diminishing supply of heating fuel makes the need for an effective ambient temperature phosphating system all the more important, since the energy cost for maintaining the processing baths or sprays at the proper elevated operating temperature is a very substantial factor in the overall cost of the phosphating operation.

With the foregoing in mind, it is a primary object of this invention to provide a process and composition for producing iron phosphate coatings at normal ambient temperatures, e.g. from 50° F. to 100° F., so as to thereby eliminate any need for providing heated cleaning and/or phosphating solutions for producing these coatings and to thus significantly conserve energy and reduce manufacturing costs.

SUMMARY OF THE INVENTION

The present invention is based on the discovery that iron phosphate coatings of excellent quality and weight can be produced on a ferrous metal surface at ambient temperatures of from 50° F. to 100° F. by treating the metal surface with an aqueous phosphating solution of specified composition and pH and including a nitrite-containing ambient temperature activator system.

The phosphating solution which is used in accordance with the present invention contains, as essential ingredients, orthophosphate ions as the source of phosphate and an ambient temperature activator system containing nitrite ions at a concentration of at least 0.08 grams per liter. The ambient temperature activator system may utilize nitrite ions as the sole activator, or the nitrite ions may be used in combination with one or more auxiliary activators or adjuvants selected from the following: nitrates, molybdates, chlorates, thiosulfates, thiosulfites, borates, perborates, peroxides, bisulfites, organic nitroaromatic compounds, organic nitroaliphatic compounds, hydroxylammonium salts, organic molybdate salts, and organic molybdate complexes. The phosphating solution may also contain inert fillers and conventional additives or processing aids.

Ambient temperature phosphating compositions in accordance with this invention may be used in either spray washers or dip tanks, and either as an iron phosphating composition alone, if so desired, or as a combination metal cleaner/iron phosphate. The compositions may thus be used in either a three-stage system where simultaneous cleaning and phosphating occur in the first stage, or in a five-stage system where precleaning is accomplished in the first stage, followed by a water rinse, and with a separate phosphating operation being carried out in the third stage. When used as a combination metal cleaner/iron phosphate, the composition preferably includes a cleaning agent selected from the group consisting of low foaming surfactants, organic solvents, and mixtures of low foaming surfactants and organic solvents. It is also envisioned that thickened phosphating compositions may be produced for brush application on a large, irregular metal surface that would not lend itself to traditional dip-tank or spray washer application.

Regardless of the particular method of application employed, or whether the phosphating operation is carried out in a three-stage, five-stage or other type of system, the phosphating composition, and any separate cleaning baths which might be used, are applied to the metal at ambient temperature (which typically is within the range of 50° F. to 100° F.) without the necessity of any heating.

The Ambient Temperature Activator System

As earlier noted, the ambient temperature activator system of this invention contains nitrite ions as an essential component thereof, which should be present in the working solution at a minimum concentration of about 0.08 grams per liter. The nitrite ion concentration should preferably fall within the range of 0.1 to 10 grams per liter, and most desirably from 0.5 to 2.5 grams per liter. The nitrite ion is preferably supplied as an alkali metal nitrite or ammonium nitrite.

The ambient temperature activator system may also include one or more auxiliary activators or adjuvants selected from the following: nitrates, molybdates, chlorates, thiosulfates, thiosulfites, borates, perborates, peroxides, bisulfites, organic nitroaromatic compounds such as nitrobenzene sulfonate or dinitrobenzene sulfonate, organic nitroaliphatic compounds such as hydroxymethyl nitromethane, hydroxylammonium salts such as hydroxylamine hydrochloride or hydroxylammonium sulfate, organic molybdate salts, and organic molybdate complexes. When used, each auxiliary activator selected from the above group should preferably be present at a concentration within the range of from about 0.1 to about 4 times the nitrite ion concentration. When used in such concentrations in combination with the nitrate ions and under the conditions specified, these auxiliary activators function as oxidizing agents or reducing agents in the phosphating solution and serve for providing enhanced control over the phosphating operation and stability to the phosphating solution. Certain of these auxiliary activators also have some effect on the color tone of the coating which is applied.

The nitrite ion has previously been considered for use as an activator in iron phosphating compositions, as noted for example in U.S. Pat. Nos. 2,891,884 and 3,726,720. However, it has been generally recognized that there are certain problems and inherent disadvantages in the use of nitrite which seriously limit its value as an activator. For example, one very significant problem which has been experienced with the use of nitrite is a difficulty in maintaining effective control over the phosphating operation and in obtaining consistent coating quality and weight. Under the processing conditions commonly used in phosphating operations, the nitrite has a tendency to break down and form various nitrogen oxides which quickly bubble out of solution. In addition to causing undesirable, even dangerous, working conditions in the vicinity of the phosphating operation, this undesirable characteristic of nitrite makes it extremely difficult to maintain effective control over the concentration of the nitrite activator in the phosphating solution. For example, U.S. Pat. No. 3,129,121 notes that while nitrite has been recognized as an activator or accelerator, it is of very restricted usefulness. Specifically, the patent notes that the coating process is extremely difficult to control and that variations in the concentration of the nitrite can result in either no coating being produced, or an unusable coating characterized by "white spot." The patent further notes that nitrite accelerated alkali metal phosphate coating solutions have been observed to produce coatings of lighter weight which are of inferior corrosion resistance and therefore not as suitable for a prepaint coating. To overcome these problems, the aforementioned patent recommends using nitrite in combination with a large amount of another activator, a saturated alkyl secondary amine. This system is disclosed to produce coatings at a minimum operating temperature of 120° F.

For the ambient temperature composition and process of the present invention, we specifically recommend against the use of amines. No improvement in coatings has been noted when amines have been added to the phosphating composition of this invention. In addition, recent chemical literature documents the reaction of primary, secondary and tertiary amines with nitrites, especially under acid conditions, to form nitrosamines, many of which are suspected carcinogens.

Notwithstanding the general recognition in the prior art of the disadvantages and limitations associated with the use of nitrites as an activator, as noted above, we have now discovered a nitrite activated phosphating composition and process which is capable of producing iron phosphate coatings of excellent quality and weight under ambient temperature conditions. Not only does the nitrite activated phosphating composition of this invention avoid the need for heated cleaning baths, but the composition and process achieves highly effective control over the phosphating operation and the quality and weight of the phosphate coatings which are produced. The nitrite activator is remarkably stable in the phosphating solutions. Additionally, the nitrite is depleted at about the same rate as the orthophosphate ions. Thus, a separate activator additive is not required for replenishing the nitrite activator to maintain the necessary concentration level thereof. All of the components of the phosphating solution can be replenished in a single addition, so that the proper balance between the orthophosphate ions and the activator ions can be easily maintained.

The Phosphating Solution

For satisfactory results at the ambient operating temperatures of the present invention, orthophosphates should be used as the source of phosphate. It has been observed that pyrophosphates, even in small quantities, inhibit the formation of a satisfactory coating on the metal surface under the conditions used in accordance with this invention. Therefore, the level of pyrophosphates should preferably be maintained as low as possible, and desirably at a concentration in the working solution of no more than about 0.1 grams per liter.

The orthophosphate ions are typically provided by a monobasic salt of orthophosphoric acid, such as ammonium dihydrogen orthophosphate, sodium dihydrogen orthophosphate or potassium dihydrogen orthophosphate. Phosphate coatings have been produced at ambient temperature with an orthophosphate ion concentration in the working solution as low as about 2.0 grams per liter. However, in order to provide quality coatings of an acceptable weight within a reasonable amount of time, the working solution should preferably have a concentration of at least about 5.0 grams per liter and most desirably a concentration within the range of from about 8.7 to about 50 grams per liter.

To prepare the solutions of this invention, the appropriate concentrate is dissolved in water at a rate of about 5 to 50 grams of concentrate per liter of water. The resulting solution generally has a pH within the range of about 3 to 6, although if necessary the pH may be adjusted by addition of phosphoric acid or an alkali. Preferably, the pH of the solution should be maintained within the range of about 3.0 to 4.7. For optimum results, we find that the pH of the phosphating solution should be tightly maintained in the 3.6 to 3.8 range, and the phosphating compositions should desirably contain pH buffering agents to assist in maintaining this range. The selection of particular compounds that produce a chemical buffering effect in the pH range listed is well within the ordinary skill of one familiar with the phosphating art.

Where cleaning of the metal surface is to be carried out in the same stage where the phosphate coating is formed, as when used in a three-stage system for example, the compositions of this invention also contain a cleaning agent. In general, any of the surfactants or solvents which are conventionally used as cleaning agents in the iron phosphating field may be used in the composition and process of this invention. The cleaning agent may, for example, contain anionic surfactants, cationic surfactants, nonionic surfactants, a combination of anionic and nonionic surfactants, or an organic solvent, such as petroleum naptha, mixed with one of these surfactant systems and wherein the solvent is either water soluble or emulsified by the surfactants present. Particularly preferred surfactants for use in a combination cleaner/phosphating solution for spray application are low foaming nonionic surfactants such as the BASF Wyandotte "Pluronics" or the Union Carbide "Tergitol Minifoam" series. When used, the cleaning agent or agents generally constitute up to about 15% by weight of the concentrate and are present in the working solution at a concentration of up to about 50 grams per liter.

The Concentrate

Concentrates for producing ambient temperature phosphating solutions in accordance with this invention consist essentially of the following compounds in the amounts specified.

| | Percent by Weight | |
|---|---|---|
| | Broad | Preferred |
| Alkali metal or ammonium dihydrogen orthophosphate | 30–95 | 70–90 |
| Alkali metal or ammonium nitrite activator | 0.5–15 | 2–10 |
| Auxiliary activators selected from the group specified herein | up to 15 | up to 10 |
| Cleaning agent | up to 15 | up to 10 |

The concentrate may also contain inert fillers and other nonreactive compounds having no significant effect on the fundamental reactions which take place during the phosphating operation. For example, the concentrate may contain up to about 40% by weight of an inert filler, such as sodium sulfate. The concentrate may also contain conventional pH buffers, defoamers, and other processing aids conventionally used in the iron phosphating field.

ILLUSTRATIVE EXAMPLES

The following examples are intended to illustrate various specific compositions in accordance with the invention and how they may be used for producing phosphate coatings at ambient temperature. These examples are not intended to be understood as limiting the scope of the invention.

EXAMPLE 1

General Purpose Cleaning/Phosphating Bath

A concentrate having the following composition is prepared:

| | Percent by Weight |
|---|---|
| Ammonium Dihydrogen Phosphate | 82% |
| Potassium Nitrite (activator) | 8% |
| Nonionic surfactants (cleaning agent) | 10% |

This concentrate is diluted in water at a rate of 25 grams per liter. The resulting solution, having a pH of about 3.8, is used in the first stage of a conventional three-stage spray washer. A ferrous metal article is directed into the washer, and the solution is sprayed at a pressure of 15 PSI and a temperature of 60° F. onto the metal article for a period of one minute so as to clean and simultaneously form an iron phosphate coating on the metal article. The metal article is then directed through an ambient temperature water rinse, followed by a final ambient temperature chromic acid rinse. The iron phosphate coating formed on the metal article has a weight of about 30 mg/sq. ft. and has a generally bluish color.

EXAMPLE 2

| Oxidizing Cleaning/Phosphating Bath | Percent by Weight |
|---|---|
| Potassium Dihydrogen Phosphate | 72% |
| Sodium Nitrite (activator) | 10% |
| Sodium Nitrate (auxiliary activator) | 8% |
| Nonionic Surfactants (cleaning agent) | 10% |

This concentrate, when diluted in water and applied as in Example 1, gives a heavier phosphate coating than in the previous example for similar treatment time. The exact coating weight will depend on the time in the phosphating stage and the nature of the metal being processed. The appearance of the coating is usually a shade of blue or gray.

EXAMPLE 3

| Oxidizing Phosphating Bath | Percent by Weight |
|---|---|
| Sodium Dihydrogen Phosphate | 87% |
| Sodium Nitrite (activator) | 5% |
| Sodium Metanitrobenzene Sulfonate (auxiliary activator) | 3% |
| Sodium Nitrate (auxiliary activator) | 5% |

This concentrate produces a coating similar to that of the previous example and is particularly useful in systems where the metal surface has been suitably cleaned in a previous stage, such as in a five-stage system.

EXAMPLE 4

| Reducing Phosphating Bath | Percent by Weight |
|---|---|
| Potassium Dihydrogen Phosphate | 80% |
| Sodium Nitrite (activator) | 10% |
| Hydroxylammonium Sulfate (auxiliary activator) | 10% |

Coatings produced by dilution and application of this composition to a suitably prepared surface are usually colored blue to gray to iridescent green.

EXAMPLE 5

| Reducing Cleaning/Phosphating Bath | Percent by Weight |
|---|---|
| Sodium Dihydrogen Phosphate | 82% |
| Sodium Nitrite (activator) | 3% |
| Hydroxylamine Hydrochloride (auxiliary activator) | 7% |
| Nonionic Surfactants (cleaning agent) | 8% |

Coatings produced by dilution and application of this composition are generally similar in appearance to those of Example 4.

EXAMPLE 6

| Oxidizing Cleaning/Phosphating Bath | |
|---|---|
| | Percent by Weight |
| Sodium Dihydrogen Phosphate | 65% |
| Sodium Nitrite (activator) | 10% |
| Sodium Nitrate (auxiliary activator) | 5% |
| Sodium Sulfate (inert filler) | 10% |
| Nonionic Surfactants (cleaning agent) | 10% |

This concentrate produces a coating similar to that of Example 2.

In the specification there have been set forth preferred embodiments of the invention, and although specific terms are employed, they are used in a generic and descriptive sense only and not for purposes of limitation.

What is claimed is:

1. A process for forming an iron phosphate conversion coating on a ferrous metal surface at ambient temperature, said process comprising applying at a temperature of from about 50° F. to about 100° F. to a ferrous metal surface an aqueous acidic phosphating solution having a pH within the range of 3 to 6 and comprising a source of phosphate consisting essentially of orthophosphate ions at a concentration of at least about 2.0 grams per liter and an ambient temperature activator comprising nitrite ions at a concentration of at least 0.08 grams per liter.

2. A process as set forth in claim 1 wherein said phosphating solution has a pH within the range of 3 to 4.7.

3. A process as set forth in claim 1 wherein said phosphating solution has a pH within the range of 3.6 to 3.8 and includes a pH buffer.

4. A process as set forth in claim 1 wherein said phosphating solution contains no more than about 0.1 grams per liter of pyrophosphate ions.

5. A process as set forth in claim 1 wherein the nitrite ion concentration of said solution is within the range of 0.1 to 10 grams per liter.

6. A process as set forth in claim 1 wherein the orthosphosphate ion concentration of said solution is within the range of 5.0 to 50 grams per liter.

7. A process as set forth in claim 1 wherein said ambient temperature activator additionally comprises one or more auxiliary activators selected from the group consisting of nitrates, molybdates, chlorates, thiosulfates, thiosulfites, borates, perborates, peroxides, bisulfites, organic nitroaromatic compounds, organic nitroaliphatic compounds, hydroxylammonium salts, organic molybdate salts, and organic molybdate complexes.

8. A process as set forth in claim 7 wherein each of said auxiliary activators present in said phosphating solution is at a concentration within the range of about 0.1 to about 4 times the nitrite ion concentration.

9. A process as set forth in claim 1 wherein said phosphating solution is applied to a previously uncleaned ferrous metal surface and said phosphating solution additionally contains a cleaning agent selected from the group consisting of low foaming surfactants, organic solvents, and mixtures of low foaming surfactants and organic solvents.

10. A process as set forth in claim 9 wherein said cleaning agent is present in said solution at a concentration of from about 0.5 grams per liter to about 50 grams per liter.

11. A process for forming an iron phosphate conversion coating on a ferrous metal surface at ambient temperature, said process comprising applying at a temperature of from about 50° F. to about 100° F. to a ferrous metal surface an aqueous acidic phosphating solution having a pH within the range of 3 to 4.7 and comprising a source of phosphate consisting essentially of orthophosphate ions at a concentration of about 5.0 to about 50 grams per liter and an ambient temperature activator comprising nitrite ions at a concentration of 0.1 to 10 grams per liter.

12. A process for forming an iron phosphate conversion coating on a ferrous metal surfacce at ambient temperature, said process comprising applying at a temperature of from about 50° F. to about 100° F. to a ferrous metal surface an aqueous acidic phosphating solution having a pH within the range of 3 to 4.7 and comprising a source of phosphate consisting essentially of orthophosphate ions at a concentration of about 5.0 to about 50 grams per liter, an ambient temperature activator comprising nitrite ions at a concentration of 0.1 to 10 grams per liter, and a cleaning agent.

13. A process as set forth in claim 11 or 12 wherein said ambient temperature activator additionally comprises one or more auxiliary activators selected from the group consisting of nitrates, molybdates, chlorates, thiosulfates, thiosulfites, borates, perborates, peroxides, bisulfites, organic nitroaromatic compounds, organic nitroaliphatic compounds, hydroxylammonium salts, organic molybdate size, and organic molybdate complexes; and wherein each of said auxiliary activators present in said phosphating solution is at a concentration within the range of about 0.1 to about 4 times the nitrite ion concentration.

* * * * *

UNITED STATES PATENT AND TRADEMARK OFFICE

CERTIFICATE OF CORRECTION

PATENT NO. : 4,298,405

DATED : November 3, 1981

INVENTOR(S) : J. Arthur Saus and Larry P. McCartney

It is certified that error appears in the above-identified patent and that said Letters Patent are hereby corrected as shown below:

Column 8 in line 31, "surfacce" should be --surface--.
Column 8 in line 48, "size" should be --salts--.

Signed and Sealed this

*Thirty-first* Day of *August 1982*

[SEAL]

*Attest:*

GERALD J. MOSSINGHOFF

*Attesting Officer*

*Commissioner of Patents and Trademarks*